US005243912A

United States Patent [19]

Ziemba

[11] Patent Number: 5,243,912

[45] Date of Patent: Sep. 14, 1993

[54] ARMING DELAY, DUAL ENVIRONMENT SAFE, PUZE

[75] Inventor: Richard T. Ziemba, Burlington, Vt.

[73] Assignee: General Electric Co., Burlington, Vt.

[21] Appl. No.: 803,856

[22] Filed: Dec. 9, 1991

[51] Int. Cl.[5] ..... F42C 15/23; F42C 25/26

[52] U.S. Cl. ..... 102/235; 102/240; 102/245; 102/251

[58] Field of Search ..... 102/235, 236, 231, 234, 102/233, 240, 249, 251

[56] References Cited

U.S. PATENT DOCUMENTS

| | | | |
|---|---|---|---|
| 316,607 | 9/1919 | Watson | 102/235 |
| 2,715,873 | 8/1955 | Thompson | 102/243 |
| 3,397,640 | 8/1968 | Ziemba et al. | 102/243 |
| 3,595,169 | 9/1969 | Ziemba | 102/235 |
| 3,871,297 | 3/1975 | Bayard et al. | 102/245 |
| 3,948,182 | 4/1976 | Means et al. | 102/245 |
| 4,242,963 | 1/1981 | Ziemba | 102/236 |
| 4,242,964 | 1/1981 | Warren et al. | 102/275 |
| 4,440,085 | 4/1984 | Rossman et al. | 102/235 |
| 4,458,594 | 7/1984 | Weber et al. | 102/240 |
| 4,480,551 | 11/1984 | LoFiego | 102/245 |
| 4,494,459 | 1/1985 | Ziemba | 102/235 |
| 4,510,869 | 4/1985 | Nicolas | 102/240 |
| 4,691,635 | 9/1987 | Winterhalter et al. | 102/251 |
| 4,942,816 | 7/1990 | Bankel et al. | 102/235 |

*Primary Examiner*—David H. Brown
*Attorney, Agent, or Firm*—Stephen A. Young

[57] ABSTRACT

This invention provides a safing and arming mechanism for a fuze for a spinning projectile including a ball rotor journaled for rotation within a cavity in the fuze. A firing pin, said cavity and a booster charge lie along the longitudinal axis of the fuze. The rotor carries a stab sensitive detonator in its diametral bore. A first spring mounted on a first seat cut into the ball normally fixes the ball with the detonator, out of alignment with the longitudinal axis of the fuze. A second spring mounted on a second seat cut into the ball also fixes the ball out of alignment. To release the ball, the first spring must be shifted aftwardly by setback force to a third seat cut into the ball, and the second spring must be enlarged by centrifugal force and removed from said second seat.

5 Claims, 8 Drawing Sheets

ARMING DELAY, DUAL ENVIRONMENT SAFE, PUZE

BACKGROUND OF THE INVENTION

1. Field of the Invention

This invention relates to an improved delay arming and safety mechanism for a fuze for a spinning projectile.

2. Prior Art

The fuze of this invention is an improvement on the conventional ball rotor safing and arming mechanical fuze used for medium caliber ammunition, an example of which is the M505A3 point detonating fuze employed in M56 20 mm High Explosive Incendiary ammunition, shown in FIG. 1.

The M505 fuze ball rotor employes a single safety device which is a "C" spring clip and which retains the explosive train, i.e. the detonator and the booster, in an out-of-line position prior to gun launch. This spring clip is defeated when the projectile exits the gun muzzle at the very high spin rate imparted to the projectile by the rifling within the gun barrel. Once the spring clip releases its grip on the out-of-line ball rotor, the rotor, due to spin dynamics, aligns itself so that the detonator within the rotor becomes oriented to the same axis as the firing pin and the booster. At this disposition, the fuze detonator is "armed" and capable of being "initiated" by the firing pin.

A shortcoming of such a ball rotor fuze is that only a single gun launch induced environment, i.e., projectile spin, suffices to arm the fuze. Desirably, a second gun launch induced environment, i.e., setback, should also be required to arm the fuze, and these should be two independent devices to respond respectively to each environment. Thus, if there are two safety devices, then if one device has been omitted in the assembly procedure, the other device may be there to keep the fuze safe.

Typically, these fuzes have a third semi-safing feature comprising a flange on the firing pin, which flange must be sheared off upon impact to free the pin to stab the detonator. Such a shearing process absorbs much kinetic energy and reduces the sensitivity of the fuze to low angle grazing impacts.

There have been many improvements proposed, including Ziemba, U.S. Pat. No. 3,595,169 and Rossman et al, U.S. Pat. No. 4,440,085, which each show a single spring clip which must respond to both setback and spin to release the ball rotor. If this single spring clip has been omitted in assembly, however, the rotor is free and may allow arming of the fuze. Other variations of interest are shown in Thompson, U.S. Pat. No. 2,715,873; Ziemba et al, U.S. Pat. No. 3,397,640; Bayard et al, U.S. Pat. No. 3,871,297; Ziemba, U.S. Pat. No. 4,242,963; Warren et al, U.S. Pat. No. 4,242,964; Weber et al, U.S. Pat. No. 4,458,594; Ziemba, U.S. Pat. No. 4,494,459; and Nicolas et al, U.S. Pat. No. 4,510,869.

Accordingly, it is an object of this invention to precondition arming of a fuze on contemporaneously but independently sensing the presence of adequate spin and setback forces.

A further object is to provide such a fuze with improved sensitivity to a grazing impact.

SUMMARY OF THE INVENTION

A feature of this invention is a safing and arming mechanism for a fuze for a spinning projectile including a ball rotor journaled for rotation within a cavity in the fuze. A firing pin, said cavity and a booster charge lie along the longitudinal axis of the fuze. The rotor carries a stab sensitive detonator in its diametral bore. A first spring mounted on a first seat cut into the ball normally fixes the ball with the detonator, out of alignment with the longitudinal axis of the fuze. A second spring mounted on a second seat cut into the ball also fixes the ball out of alignment. To release the ball, the first spring must be shifted aftwardly by setback force to a third seat cut into the ball, and the second spring must be enlarged by centrifugal force and removed from said second seat.

Additionally a third spring mounted on a seat on the firing pin must be enlarged by centrifugal force to free the firing pin prior to impact.

BRIEF DESCRIPTION OF THE DRAWING

These and other objects, advantages and features of this invention will be apparent from the following specification thereof taken in conjunction with the accompanying drawing in which.

DESCRIPTION OF THE PREFERRED EMBODIMENT

Figure 1:
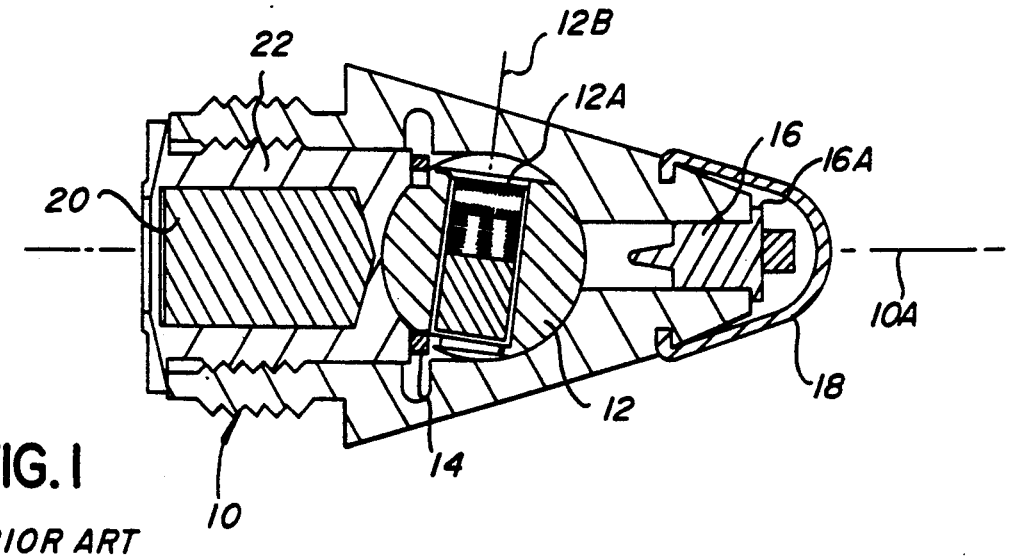
FIG. 1 PRIOR ART
FIG. 1 is a longitudinal cross-section of the prior art M505 fuze.

FIG. 1 shows the prior art standard M505 fuze comprising a fuze body 10, a rotor 12, a detonator capable of being initiated at only one end 12A thereof; a rotor detent "C" spring 14, for retaining the rotor against rotation with the 12A end of the axis of the detonator (12B) at less than 90°, e.g. 85°, of the longitudinal axis 10A of the fuze, a firing pin 16 having a flange 16A, a nose cap 18, a booster charge 20, and a booster holder 22. The projectile is spun up during its passage through the barrel, the "C" spring fails due to spin forces at its narrow section releasing the rotor, which precesses to align the detonator axis 12B with the projectile spin axis 10A with the end 12A adjacent to the firing pin 16. Upon impact, the nose cap 18 must be crushed and the flange 16A sheared before the firing pin may be accelerated toward the detonator. If the "C" spring 14 is omitted during assembly, the rotor is subsequently free to wander and perhaps align its axis 12B with the axis 10A.

Figure 2A:
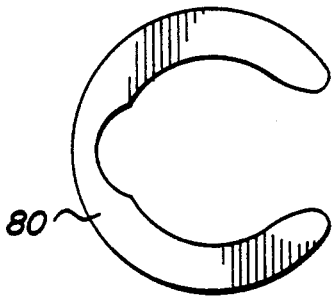
FIG. 2A is a top view of the "C" spring clip for the rotor which is similar to the M505 clip.
Figure 2B:
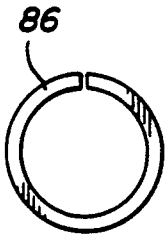
FIG. 2B is a top view of the split ring for the rotor.
Figure 2C:
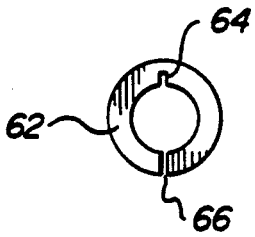
FIG. 2C is a top view of the split ring for the firing pin.
Figure 2:
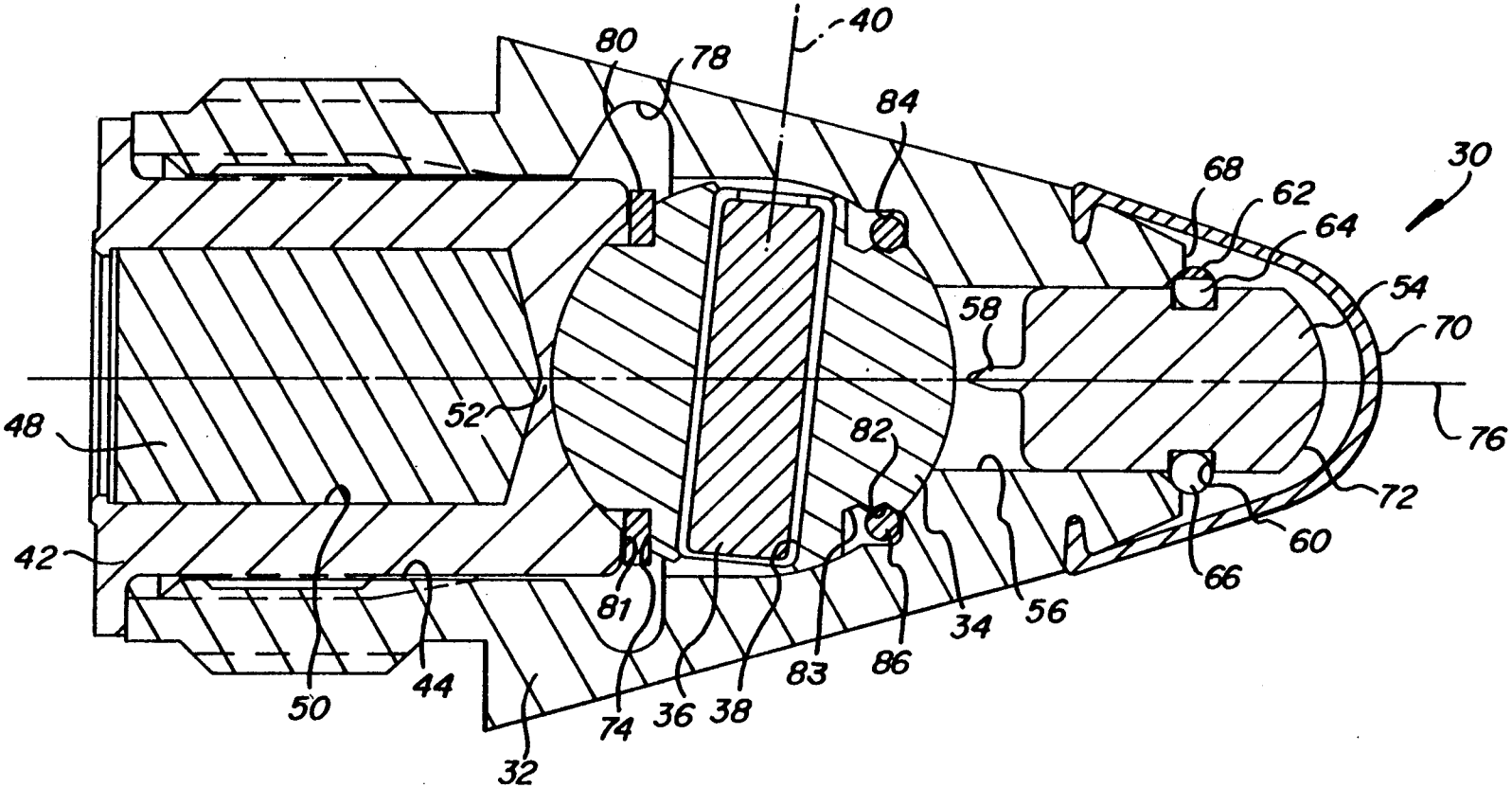
FIG. 2 is a longitudinal cross-section of a first embodiment of this invention in the fuze "safe" disposition.

FIG. 2 shows the preferred embodiment of this invention. This fuze 30 comprises a fuze body 32, a rotor 34, a detonator 36 fixed in a bore 38 on an axis 40 of mass symmetry in the rotor, a booster holder 42 is secured by mating threads in an aft cavity 44 in the body and jointly with the body provides a central substantially spherical cavity 46 in which the rotor is journaled. A booster charge 48 is fixed in a blind bore 50 in the holder, and is spaced from the rotor by a thin web 52. A firing pin 54 is partially disposed in a forward bore 56 in the body 32 and has an aftwardly directed spike 58. The pin 54 has an annular groove 60 in which is disposed a split ring 62, also shown in FIG. 2C, and which has a notch 64 diametrically opposite the split 66. The ring 62 engages the forward, truncating face 68 of the body and precludes aftward movement of the pin 54 in the bore 56 towards the rotor. A crushable cap 70 is secured over the forward face 68 of the body and the head 72 of the pin and captures the pin in the bore 56.

An annular groove 74 is formed in the aft face of the rotor, on a diametrical axis 75, coaxial with body axis 76, considering the rotor axis 40 to be at 85° to the axis 76 of the body, and is opposite an annular groove 78 formed in the body. A "C" spring rotor detent 80, also shown in FIG. 2A, is disposed in the annular groove 74, abutting the annular front face 81 of the holder 42, and aligned with the groove 78.

A pair of adjacent annular grooves, 82 distal and 83 proximal, are formed on the front face of the rotor, both coaxial with the groove 74. The distal groove 82 is opposite an annular groove 84 formed in the body. A split ring 86, also shown in FIG. 2B, is disposed in the distal groove 82.

It will be seen that both the "C" spring 80 by its abutment against the booster holder front face 81 and the split ring 86 by its abutment with the body groove 84 preclude any rotation of the rotor 34 from its 85° misalignment with the projectile axis 76. The split ring 62 by its abutment against the face 68 precludes any aftward movement of the firing pin 54 towards the rotor 34.

Figure 3:
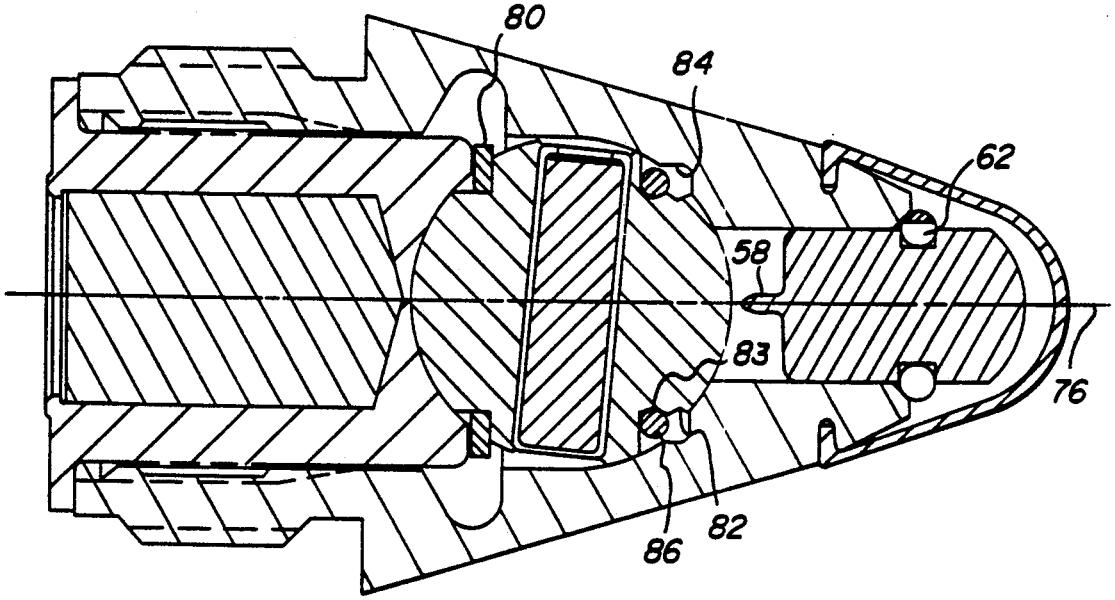
FIG. 3 is a longitudinal view of the fuze of FIG. 2 in the "setback" disposition.

During storage and transportation the fuze is in the disposition shown in FIG. 2. Upon firing of the round of ammunition, i.e. "launch" of the projectile, the fuze is accelerated into its "setback" disposition as shown in FIG. 3, wherein as the fuze is accelerated, at e.g., at 105,000 gs, the inertia of the split ring 86 causes it to snap over the ridge between the pair of grooves, from the distal groove 82 into the proximal groove 83, and out of abutment with the groove 84 in the body. Thus the safety of the rotor provided by the split ring 86 has been defeated independently of the "C" spring 80 which continues to lock the rotor in its "safe" disposition.

Figure 4:
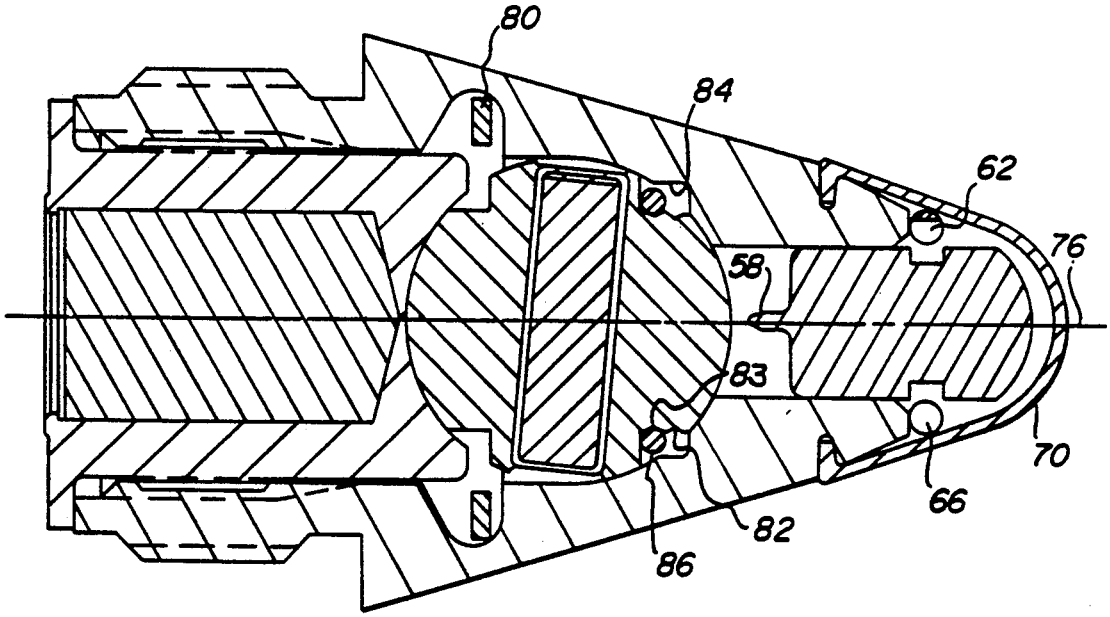
FIG. 4 is a longitudinal view of the fuze of FIG. 2 in the "muzzle exit" or "spun up" disposition.

As the projectile is accelerated along the length of the gun barrel towards the muzzle, the interaction of the rifling in the bore of the gun barrel with the rotating band of the projectile causes the projectile to be spun up about its longitudinal axis 76 to a maximum rotational velocity as it exits the muzzle. This rotational velocity, as shown in FIG. 4, at, e.g., 65,000 rpm, causes the arms of the "C" spring 80 to spread apart into the groove 78 and break apart, out of abutment with the face 81 of the booster holder. Thus the safety of the rotor provided by the "C" spring has been defeated independently of split ring 86. The rotational velocity also causes the arms of the split ring 62 to spread apart out of the groove 60 and to break apart at the notch 64 to permit the firing pin 54 to "float" in the bore 56.

Figure 5:
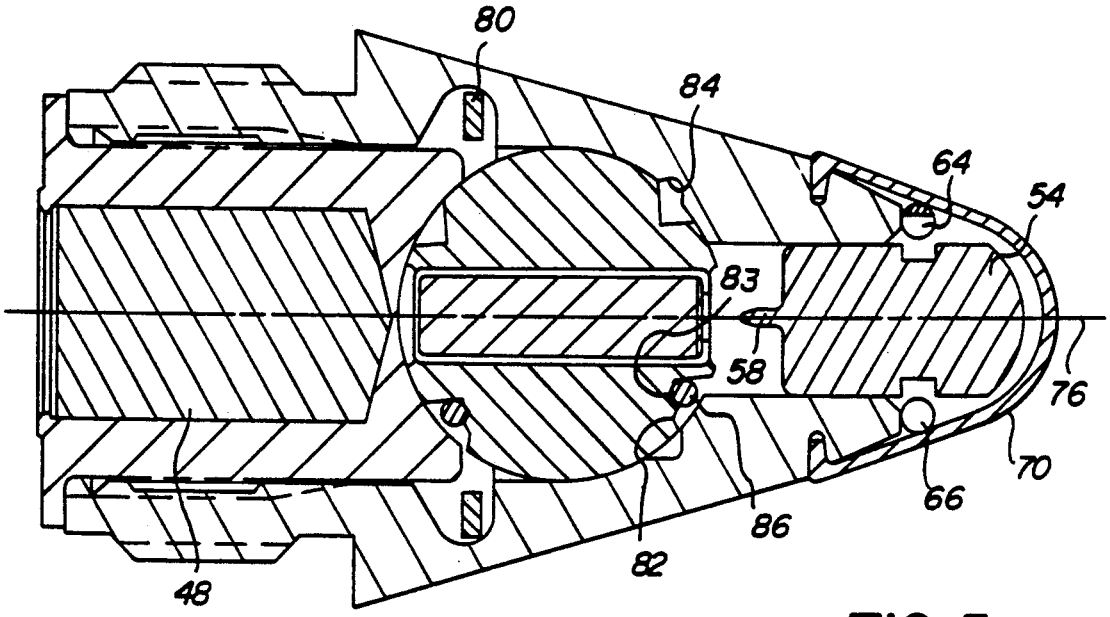
FIG. 5 is a longitudinal view of the fuze of FIG. 2 in the "armed" disposition.

After the "C" spring 80 has broken, due to dynamic mass unbalance the rotor precesses within the spinning projectile to bring the detonator into alignment with the firing pin and the booster (on axis 76) to the "armed" disposition as shown in FIG. 5.

Figure 6:
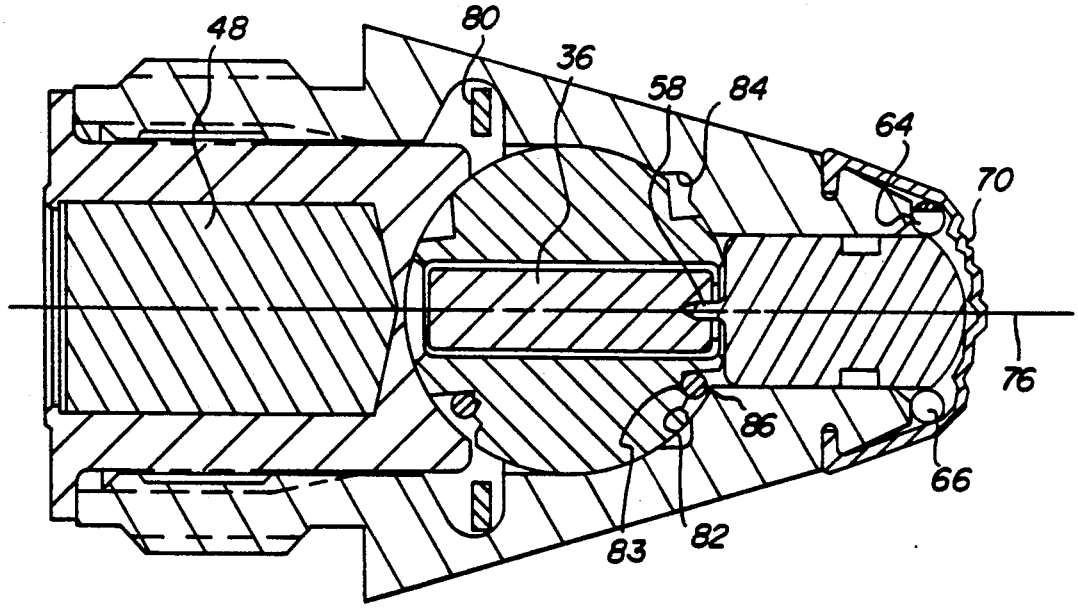
FIG. 6 is a longitudinal view of the fuze of FIG. 2 in the "percussed" disposition.

Upon target impact, the nose is crushed and the firing pin is accelerated to stab the detonator as shown in FIG. 6.

Figure 7:
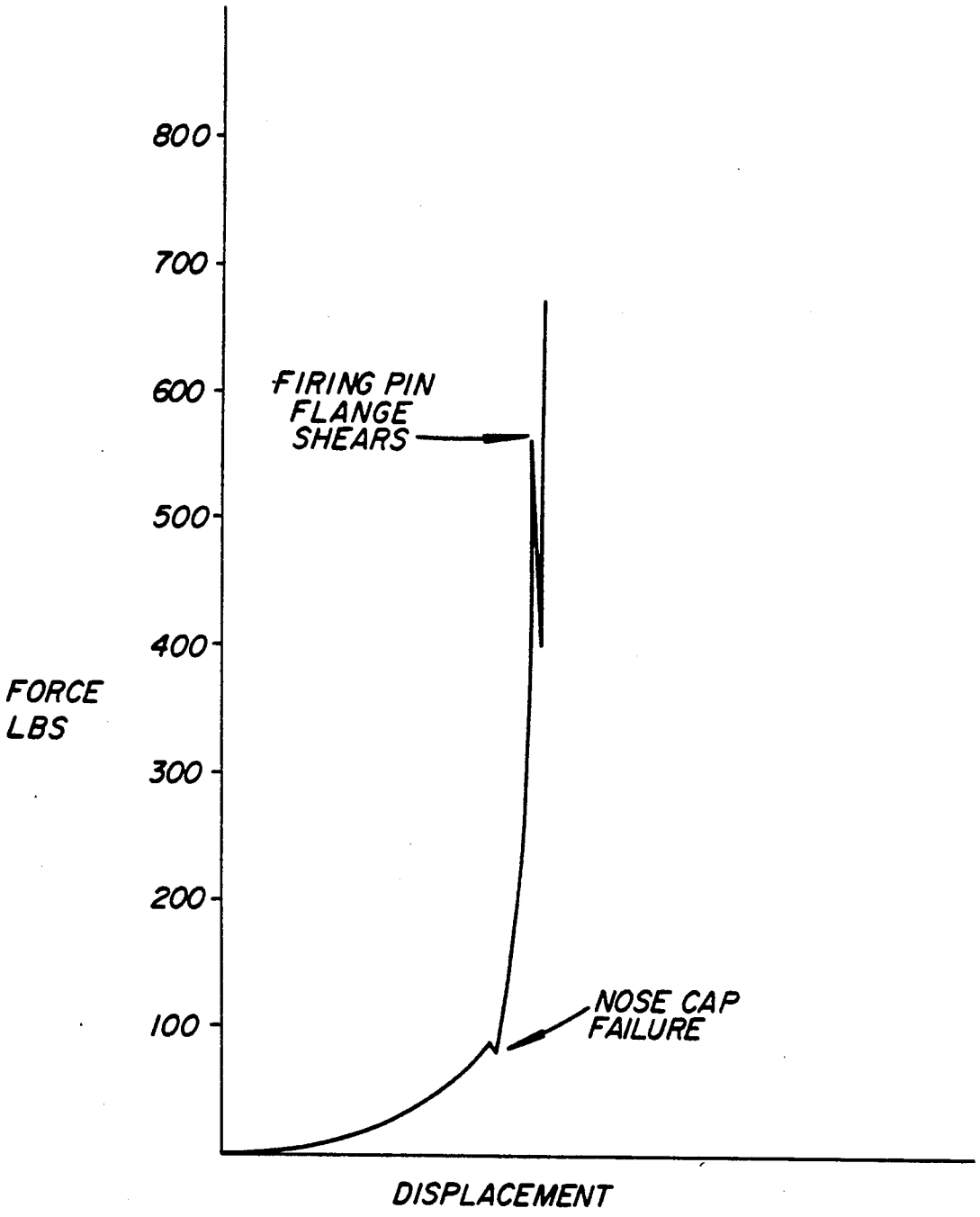
FIG. 7 is a chart showing the kinetic energy absorbed by a conventional firing pin.

It will be seen that the substitution of the split ring 62 for the conventional flange on the firing pin greatly increases the sensitivity of the fuze to a low energy grazing impact. The absorption of kinetic energy by the conventional flange in shear is shown in FIG. 7. In the present invention, the split ring, resting in the groove 60, supports the firing pin 54 against setback force, but at the time the projectile has left the gun barrel, centrifugal force causes the split ring to open and free the pin to "float" beneath the nose cap of the fuze 80, and that the only resistance offered to its travel into the detonator at target impact is that force which is required to crush the nose cap, thus making the fuze more sensitive to targets at reduced projectile strike velocity.

Figure 8:
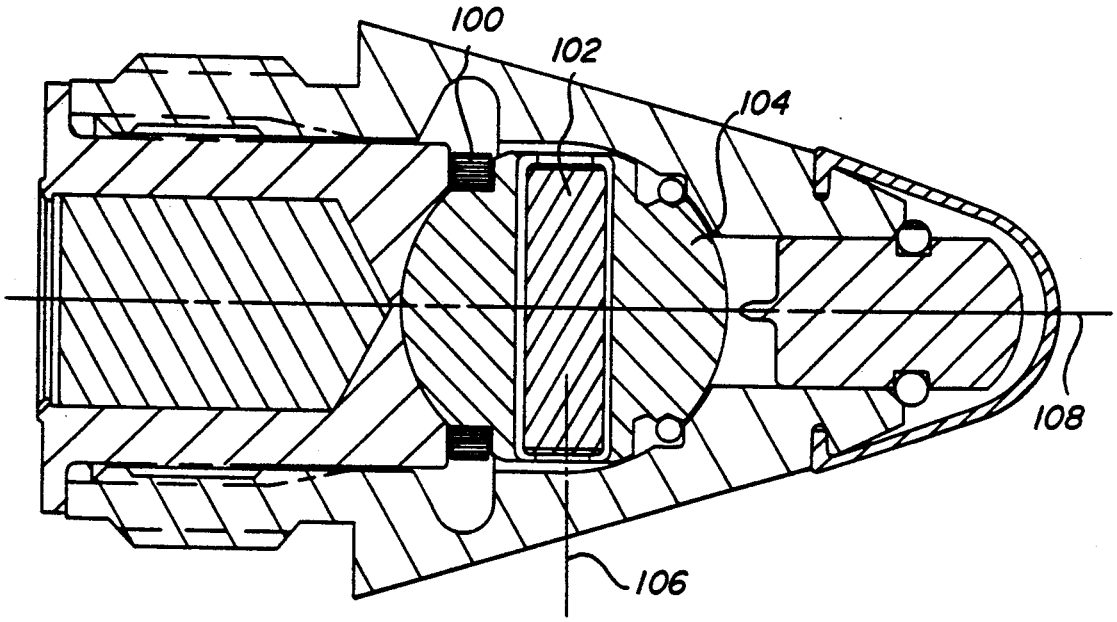
FIG. 8 is a longitudinal view of a second embodiment of this invention in the fuze "safe" disposition.

An alternative embodiment of this invention is shown in FIG. 8. In this embodiment an unwinding ribbon 100 is substituted for the "C" spring of the first embodiment. This unwinding ribbon performs two functions: First, it serves as the spin safety of the fuze, i.e., the rotor cannot precess to the armed disposition until the ribbon has spun free of the rotor. Second, the time required to unwind the ribbon represents the larger part of the delay in the arming of the fuze. The smaller part of the delay is the time required for the rotor to precess to its "armed" disposition after the ribbon has unwound free of the rotor.

Use of an unwinding ribbon as a combination spin safety and arming delay mechanism is made feasible by the use of a double ended detonator.

Figure 9:
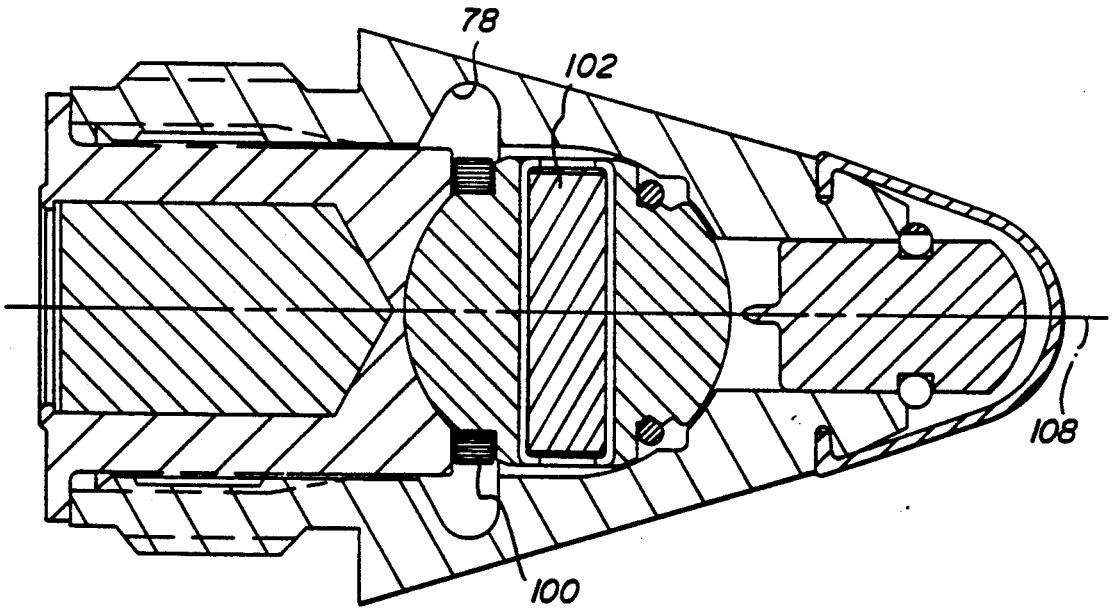
FIG. 9 is a longitudinal view of the fuze of FIG. 8 in the "setback" disposition.
Figure 10:
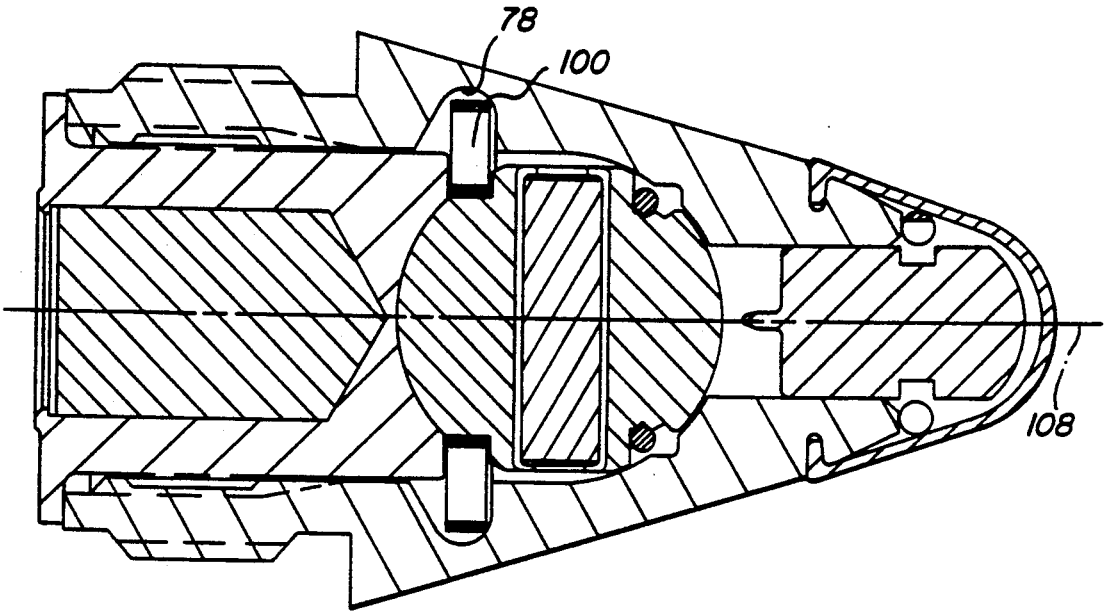
FIG. 10 is a longitudinal view of the fuze of FIG. 8 in the "muzzle exit" disposition.
Figure 11:
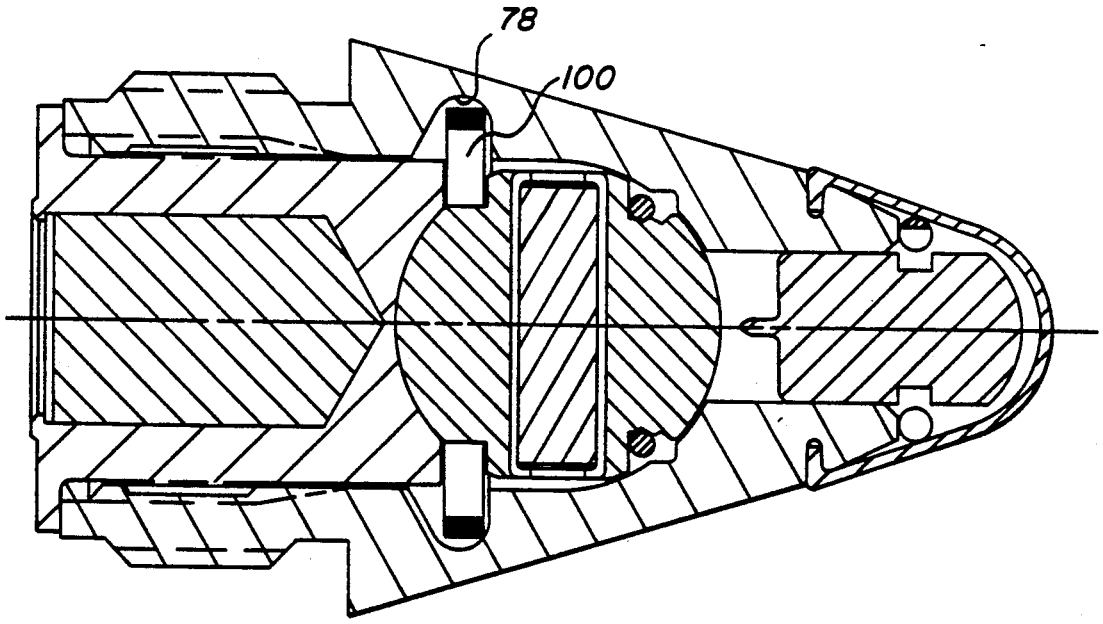
FIG. 11 is a longitudinal view of the fuze of FIG. 8 in the "post muzzle exit" disposition.
Figure 12:
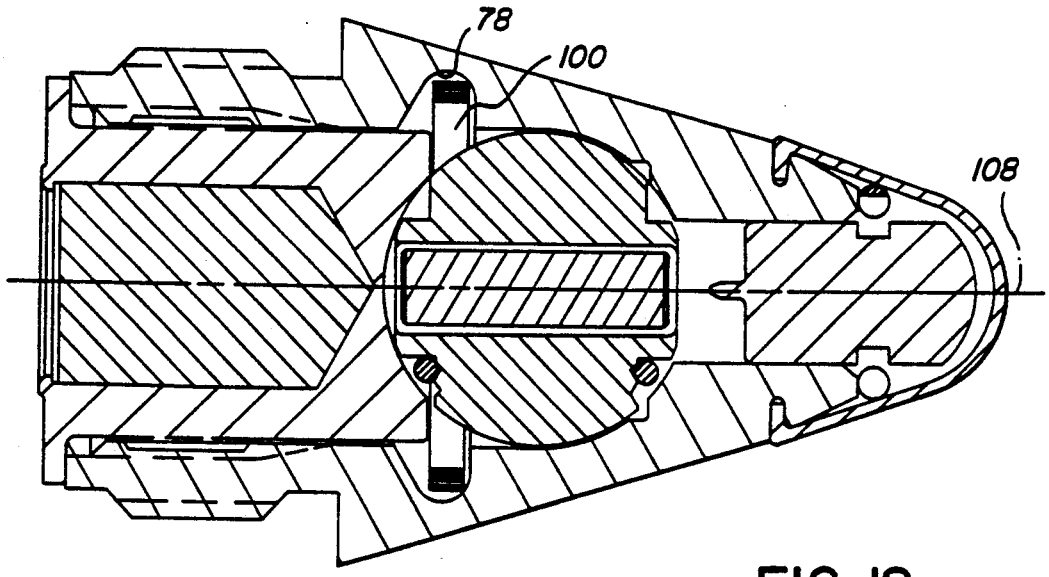
FIG. 12 is a longitudinal view of the fuze of FIG. 8 in the "armed" disposition.
Figure 13:
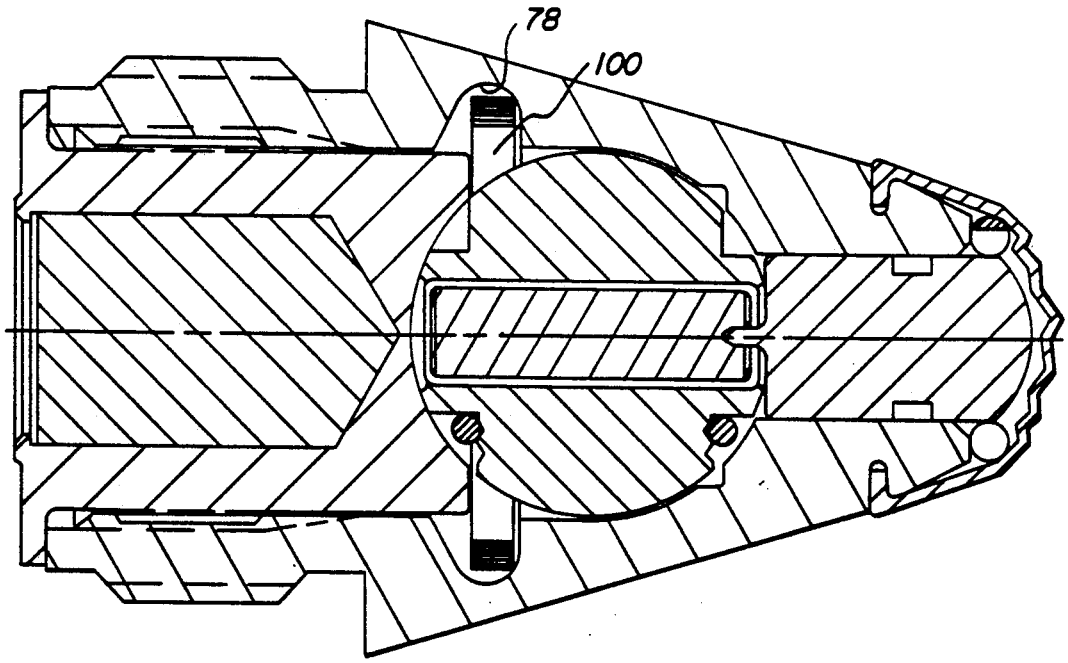
FIG. 13 is a longitudinal view of the fuze of FIG. 8 in the "percussed" disposition.

This embodiment employs a unique detonator 102 which makes possible the use of an unwinding ribbon as both a spin safety and an arming delay mechanism. This detonator contains a single primary explosive charge of Mercury 5 Trinitrotetrozole which is a high output explosive which is also stab sensitive. Since this detonator can be stab initiated at either end thereof, it does not matter through which direction the rotor 104 precesses to its "armed" disposition. Therefore, the detonator 102 in the "safe" disposition can be held with its axis 106 at 90° to the longitudinal axis 108 of the projectile. Since the driving torque causing the rotor to precess from the 90° initial position is essentially zero and increases, as a function of the detonator axis, to a maximum at 45°, it is possible for the ribbon to retain the rotor in its 90° position until the ribbon is fully unwound without the ribbon binding due to excessive rotor torque loads. The length of the delay is a function of the length of the ribbon, which after setback as shown in FIG. 9, unwinds into the groove 78 as shown in FIG. 10 and 11, and hence to permit the rotor to precess into the "armed" disposition shown in FIG. 12. Either end of the detonator may be presented to the firing pin which stabs the detonator on impact with the target as shown in FIG. 13. The length of the delay provided by the unwinding ribbon of the second embodiment may be made much longer than the delay provided by the 85° rotor design shown in FIG. 2.

What is claimed is:

1. A delay armed fuze having a safed disposition and an armed disposition for a spinning projectile, comprising:

a housing having a longitudinal axis extending fore and aft, and a substantially spherical cavity therein which is symmetrical about said axis, and has a first annular face and a second annular face;

a substantially spherical rotor disposed in said cavity having an axis of mass symmetry and a diametral bore coaxial therewith and adapted to receive a detonating charge therein;

a first annular groove formed into the periphery of said rotor perpendicular to a first diametrical axis, which first diametrical axis is angularly displaced from said axis of mass symmetry, and which first diametrical axis in the safed disposition, is coaxial with said housing longitudinal axis, and said groove is spaced aftwardly of said diametral bore;

a second annular groove formed into the periphery of said rotor perpendicular to said first diametrical axis, and spaced forwardly of said diametral bore;

a third annular groove formed into the periphery of said rotor perpendicular to said first diametrical axis, and spaced forward of said diametrical bore and adjacent and aftward of said second groove;

a first annular cavity formed into said housing substantially coplanar with said first annular groove in said rotor;

first means disposed in part in said first annular groove and engaged with said housing first face to preclude rotation of said rotor;

second means disposed in part in said second annular groove and engaged with said housing second face to preclude rotation of said rotor;

said fuze having a mode of operation wherein:

upon set-back of said fuze, said second means to preclude rotation moves from said second annular groove to said third annular groove to disengage said second face, and upon spin-up of said fuze, said first means to preclude rotation moves from said first annular groove to said first annular cavity to disengage said first face, whereupon said rotor is free to rotate from said safed disposition to said armed disposition.

2. The fuze of claim 1 wherein:

said first means is a "C" clip.

3. The fuze of claim 1 wherein said first means is an unwinding ribbon.

4. The fuze of claim 1 wherein said safe disposition of said rotor axis of mass symmetry is at an angle in the range of over 85° through and including 90° to the longitudinal axis of the fuze body.

5. The fuze of claim 1 further including:

a longitudinal bore in said fuze housing coaxial with said housing longitudinal axis;

a forward face on said housing;

a firing pin, disposed partially in said housing longitudinal bore, having a substantially cylindrical body having a head protruding forwardly from said bore;

an annular groove in said cylindrical surface;

third means disposed in part in said pin annular groove and engaged with said housing forward face to preclude rearward movement of said pin when said fuze is in said safe disposition;

said fuze mode of operation further including;

upon spin-up of said fuze, said third means to preclude rearward movement of said pin disengages from said pin groove.

* * * * *